US007207873B2

(12) United States Patent
Hesse et al.

(10) Patent No.: US 7,207,873 B2
(45) Date of Patent: Apr. 24, 2007

(54) HAND MACHINE TOOL WITH CLAMPING DEVICE

(75) Inventors: Juergen Hesse, Waldenbuch (DE); Eike U. Von Specht, Magdelburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/564,670

(22) PCT Filed: Nov. 2, 2004

(86) PCT No.: PCT/EP2004/052759

§ 371 (c)(1),
(2), (4) Date: Jan. 13, 2006

(87) PCT Pub. No.: WO2005/063439

PCT Pub. Date: Jul. 14, 2005

(65) Prior Publication Data

US 2006/0172669 A1 Aug. 3, 2006

(30) Foreign Application Priority Data

Dec. 30, 2003 (DE) ..... 103 61 810

(51) Int. Cl.
*B24B 23/00* (2006.01)

(52) U.S. Cl. ..... 451/359; 451/344

(58) Field of Classification Search ..... 451/342, 451/359, 353, 344
See application file for complete search history.

(56) References Cited

U.S. PATENT DOCUMENTS 3,818,644 A * 6/1974 Walters ..... 451/342
3,893,267 A * 7/1975 Swinehart et al. ..... 451/470
4,059,930 A * 11/1977 Alessio ..... 451/451
4,251,955 A * 2/1981 Shawke ..... 451/342
4,597,227 A 7/1986 Gentischer et al.
5,157,873 A * 10/1992 Rudolf et al. ..... 451/342
5,163,250 A * 11/1992 Weber ..... 451/342
6,796,888 B2 9/2004 Jasch
6,869,346 B2 * 3/2005 Wendt et al. ..... 451/342
6,949,017 B2 * 9/2005 Koschel et al. ..... 451/358
6,966,824 B2 * 11/2005 Kotting et al. ..... 451/177

FOREIGN PATENT DOCUMENTS

EP 0 152564 8/1985
EP 0 495 181 7/1992
EP 1 213 107 A1 6/2002

* cited by examiner

*Primary Examiner*—Eileen P. Morgan
(74) *Attorney, Agent, or Firm*—Michael J. Striker

(57) ABSTRACT

A hand power tool has a disk-shaped tool, and a clamping device for clamping the tool, the clamping device including at least one flange and a clamping unit for clamping the tool to the at least one flange and passing through the tool, the clamping unit and the at least one flange being configured on a key-end-keyhole principle, so that after passing axially through one another and subsequently being rotated counter to one another, the clamping unit and the at least one flange axially fix one another at least in one axial direction.

5 Claims, 5 Drawing Sheets

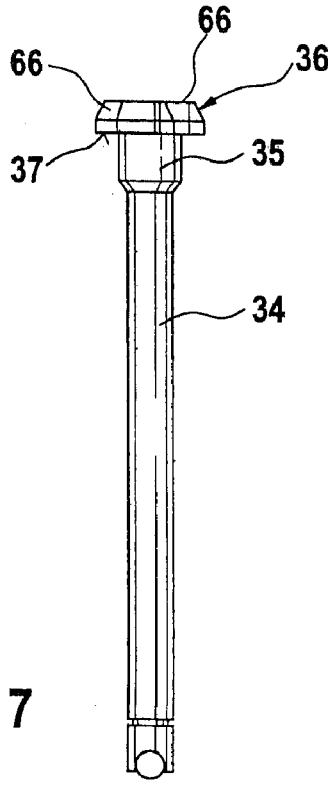
Fig. 7
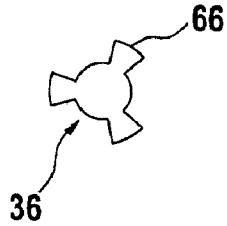
Fig. 8
Fig. 9
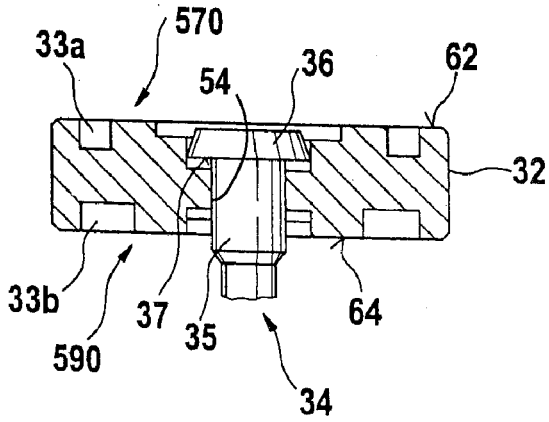

HAND MACHINE TOOL WITH CLAMPING DEVICE

CROSS-REFERENCE

The invention described and claimed hereinbelow is also described in PCT/EP 2004/052759, filed on Nov. 2, 2004 and DE 103 61 810.4, filed on Dec. 30, 2003. This German Patent Application, whose subject matter is incorporated here by reference, provides the basis foe a claim of priority of invention under 35 U.S.C. 119 (a)–(d).

BACKGROUND OF THE INVENTION

The present invention is related to a hand power tool.

From European Patent Disclosure EP 152 564, a hand power tool is known whose disklike tool can be detachably secured to a work spindle for rotational slaving by means of flanges that can be locked in screwable or bayonetlike fashion.

This hand power tool has a fast-action clamping means, with a tension spindle which passes through the work spindle and pulls the outer of the flanges against the disklike tool. The clamping stroke of the tension spindle must be adapted to disklike tools of different thickness, so that an adequate clamping force for fixation of a given tool can be achieved.

Adapting the clamping stroke is complicated and time-consuming.

SUMMARY OF THE INVENTION

Accordingly, it is an object of the present invention to provide a hand power tool with a clamping device, which eliminates the disadvantages of the prior art.

Because one flange defines different clamping planes, the clamping means to fit the commercially available disklike tools of different thickness can always be associated with them without calibration effort. This assures that both tools with a maximum thickness and those with a minimum thickness can always be clamped with an adequate clamping force to the hand power tool.

Because the clamping means has three clamping tabs, which are braced against a corresponding support edge of the one flange, relatively high clamping forces can be transmitted.

Because the flange forms two support edges, each in a different plane, on its front side and its back side, a total of four support planes are available with the flange, and with these planes all the commercially available disklike tools can be clamped.

DRAWINGS

The novel features which are considered as characteristic for the present invention are set forth in particular in the appended claims, the invention itself, however, both as to its construction and its method of operation, together with additional objects and advantages thereof, will be best understood from the following description of specific embodiments when read in connection with the accompanying drawings.

Figure 1:
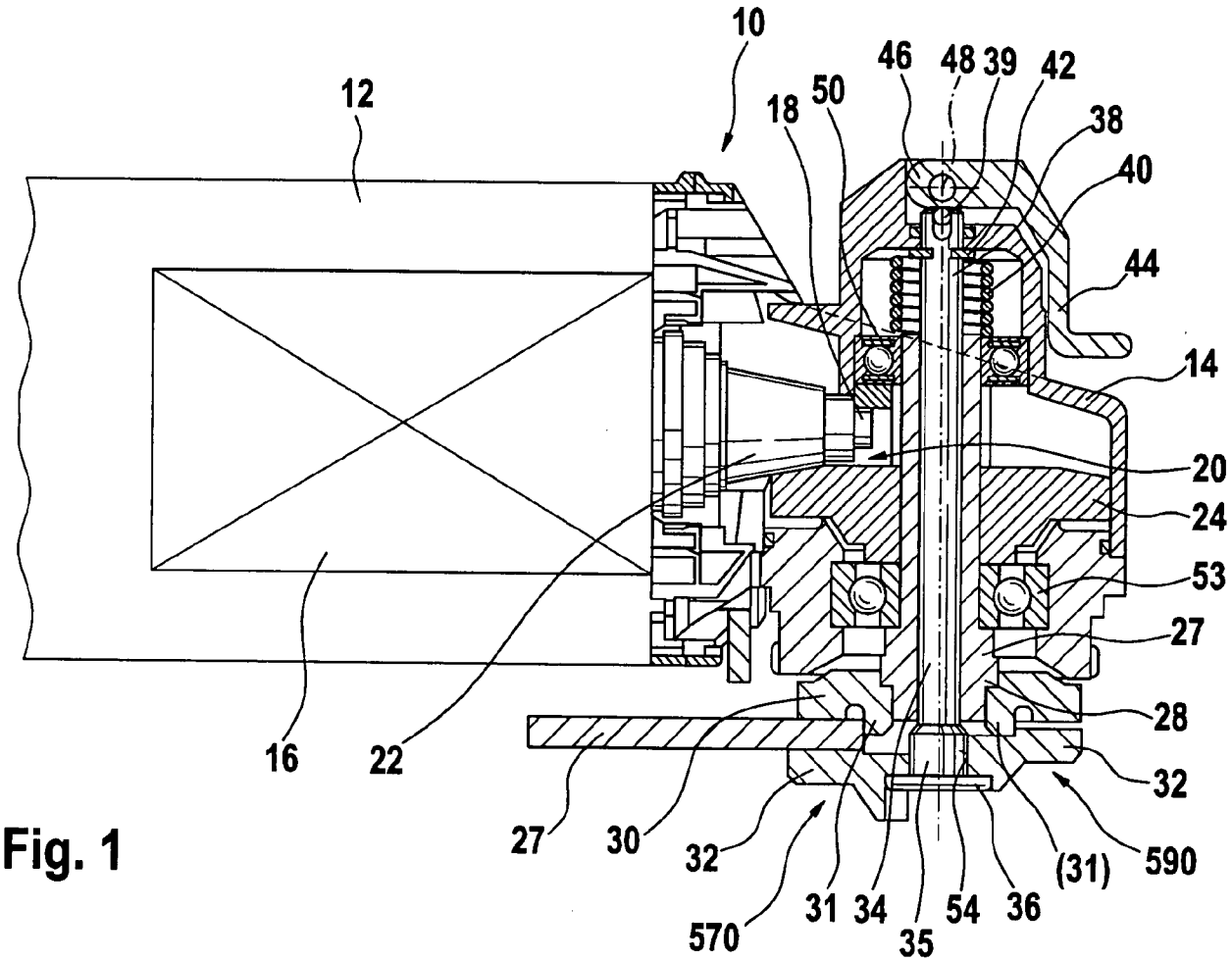
Figure 2:
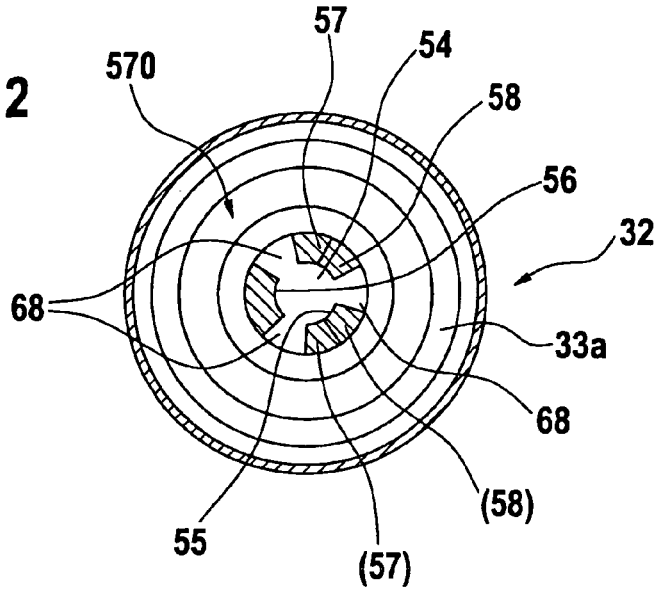
Figure 3:
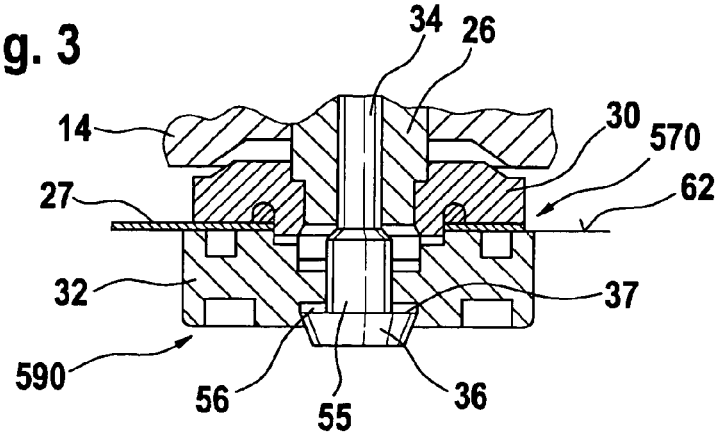
Figure 4:
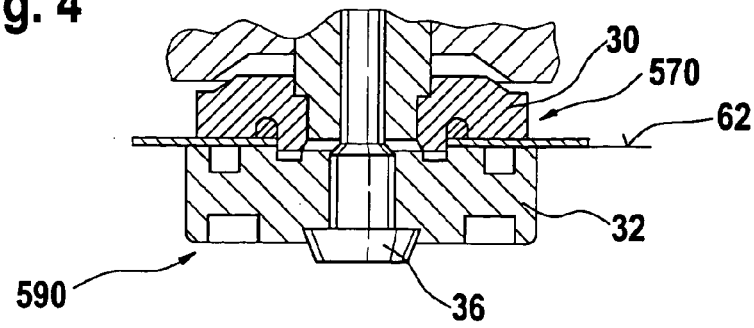
Figure 5:
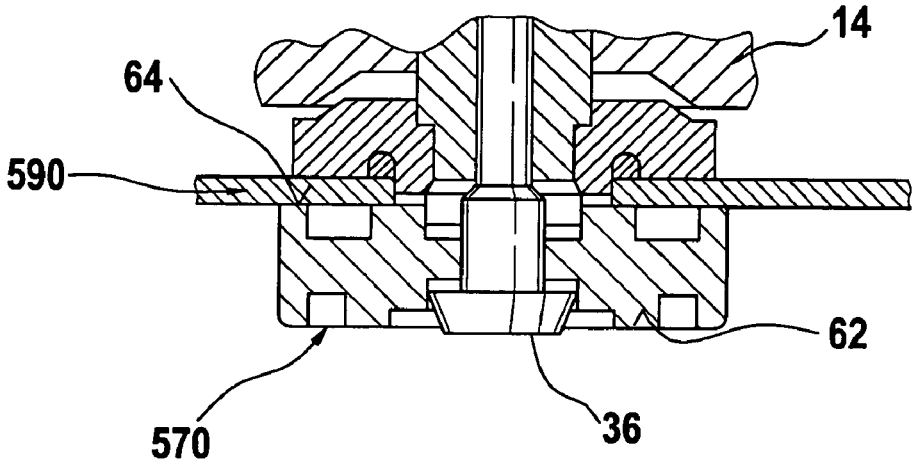
Figure 6:
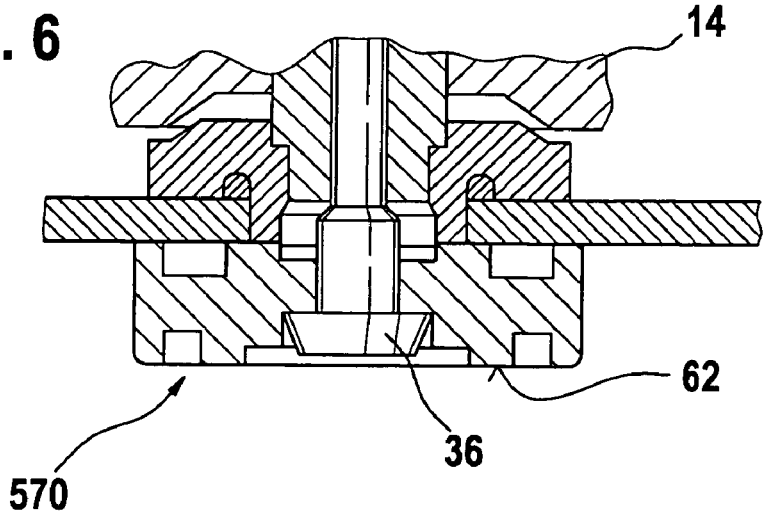
Figure 10:
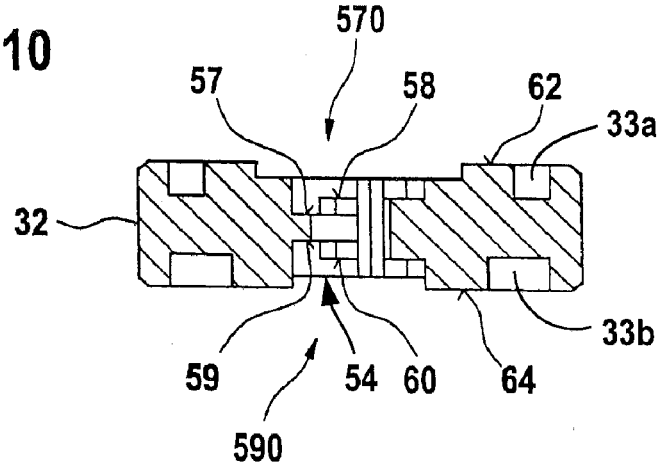
Figure 11:
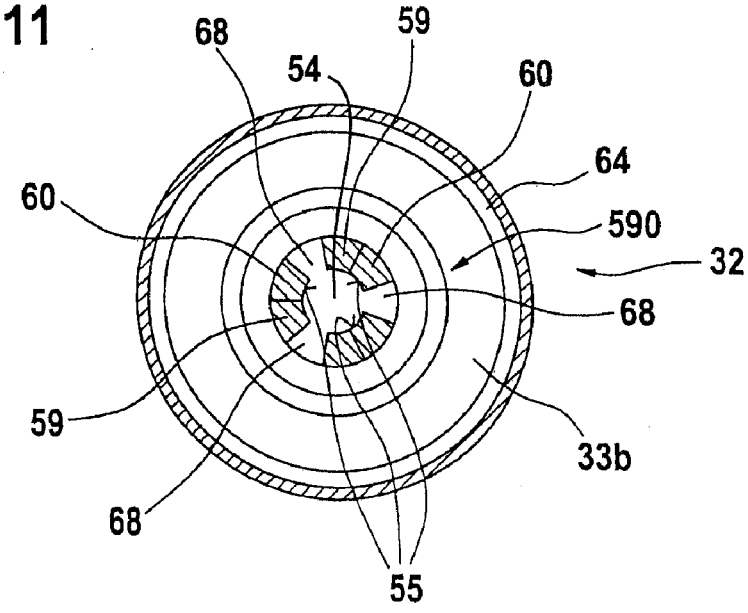

FIG. 1, a longitudinal section through the hand power tool;

FIG. 2, a top view on the front side of the clamping flange;

FIG. 3, a first longitudinal section through the clamping flange in a first clamping position;

FIG. 4, a second longitudinal section through the clamping flange in a second clamping position;

FIG. 5, a third longitudinal section through the clamping flange in a third clamping position;

FIG. 6, a fourth longitudinal section through the clamping flange in a fourth clamping position;

FIG. 7, a detail of a tension spindle;

FIG. 8, a detail of the clamping means;

FIG. 9, a cross section of the clamping means with the clamping flange;

FIG. 10, the cross section of the clamping means as a detail;

FIG. 11, a top view on the back side of the clamping flange.

DESCRIPTION OF THE PREFERRED EMBODIMENTS

FIG. 1 shows a hand power tool 10, designed as a right-angle grinder, in longitudinal section. The hand power tool 10 comprises an elongated motor housing 12, to which a gearbox 14 bent downward at an angle is flanged. The motor housing 12 supports a motor 16, whose motor shaft 18 protrudes into the gearbox 14. The end of the motor shaft 18 supports a motor pinion 22, designed as a conical gear wheel. The motor pinion 22, together with a ring gear 24, forms an angular gear 20. In a manner fixed against relative rotation, the ring gear 24 embraces a power takeoff shaft 26, which in turn, on its end, carries a disklike tool in the form of a grinding wheel 27 in a manner fixed against relative rotation. The grinding wheel 27 is guided by a central recess, not identified by reference numeral, over the free end of the power takeoff shaft 26 and secured replaceably to it in clampable fashion. It is braced in centered fashion on the machine on the centering collar 31 of a support flange, which is seated, in a manner fixed against relative rotation and axially secured, to a stepped collar 28 of the power takeoff shaft 26.

From the side facing away from the machine, or from outside, a clamping flange 32 is braced on the grinding wheel 27. With its front side 570, the clamping flange—half of it is shown—is oriented outward on the left in the viewing direction, and with its back side 590, it is oriented toward the grinding wheel 27. In this position, the clamping flange 32 is intended for receiving grinding wheels 27 of great thickness, of about 5 mm, and aids the clamping system in achieving optimal clamping force exerted by the clamping springs 40, installed in the upper region of the gearbox 14 and designed as cup springs.

On the right in the viewing direction, the clamping flange 32, only half of which is also shown, is oriented with its back side 590 outward and with its front side 570 toward the grinding wheel 27. In this position, the clamping flange 32 is intended to receive grinding wheels 27 of minimal thickness, of approximately 0.8 mm, and also helps the clamping system attain an optimal clamping force, which is exerted by the clamping springs 40, installed in the upper region of the gearbox 14 and designed as a cup spring assembly—axially secured via a snap ring 42—in the region of the upper end 38 of the tension spindle.

The clamping shaft 35 of a mushroom-shaped clamping head 36, which belongs to the tension spindle 34, reaches through the clamping flange 32 through its center hole 54 and is braced on the outside, with a flat clamping face 37, on the clamping edge 56 of the clamping flange 32. The clamping head 36 and the center hole 54 have a star-shaped embodiment corresponding to one another, on the order of a key-and-keyhole or bayonet mount system, in which after being inserted through and then rotated, axial bracing of the parts against one another with engagement from behind is accomplished, as will be described in further detail hereinafter.

On the outermost, upper end 38 of the tension spindle, a roller bearing support ball 39 is located as wear protection, and on it, a clamping lever 44 is braced with its eccentric region 46, when this lever is pivoted about its pivot axis 48 for releasing the grinding wheel 27 and in the process presses the tension spindle 34 downward. If, in the release position, the clamping head 36 is axially released from the clamping flange 32, then this flange can be rotated such that its star-shaped recesses 68 on the edge of the center hole 54 coincide with the star-shaped radial clamping tabs 66 (FIG. 8) of clamping head 36, and thereupon the clamping flange 32 and then also the grinding wheel 27 can be removed axially from the right-angle grinder 10.

The work shaft 26, embodied as a hollow shaft, is penetrated centrally by the tension spindle 34 and is supported rotatably in a respective upper and lower spindle bearing 50, 52.

The clamping flange 32, shown from its front side 570 in FIG. 2, allows the circular center hole 54 to be seen, which is pierced radially outward by three star-shaped recesses 68 going beyond it. The clamping edge 56 can also be seen, which extends annularly—having the differential diameter of the recesses 68 and the center hole 54.

The clamping edge 56 of the clamping flange 32 is interrupted at regular intervals by three recesses 68 and forms three support tabs 55, which have two first steplike clamping planes 57, 58 on the front side 570 and two further steplike clamping planes 59, 60 on the back side 590, on which planes the three clamping tabs 66 of the clamping head 36 can be braced by their flat clamping face 37, after appropriate rotation of the clamping flange 32 relative to the clamping head 36. As a result, the clamping flange has four different clamping planes, with which all the commercially available grinding wheels can be securely clamped with little effort to the right-angle grinder 10.

On its front side 570, the clamping flange 32 has an encompassing, narrow marking groove 33*a*, and on its back side 590 (FIG. 11), it has an encompassing wide marking groove 33*b*; with these grooves, the front and back sides 570, 590 can easily be told apart.

FIGS. 3, 4, 5 and 6 show a detail of the lower region of the power takeoff shaft 26 with the support flange 30, the clamping flange 32, and the clamping head 36; in FIG. 3, the clamping flange 32 is braced with its front side 570, that is, its first support face 62, on a minimally thin grinding wheel 27 and securely fastens this grinding wheel. In the process, the clamping head 36, with its clamping face 37, is braced against the axially farthest outwardly positioned clamping plane 57, so that the optimal clamping force between the support and clamping flanges 30, 32 exists in a gap width range of approximately 0.7 to 1.7 mm.

In FIG. 4, unlike FIG. 3, the clamping head 35 is braced against the axially inner clamping plane 58, so that the optimal clamping force between the support and clamping flanges 30, 32 exists at a gap width of approximately 1.7 to 2.8 mm.

In FIG. 5, unlike FIGS. 3 and 4, the clamping flange 32 is braced by its back side 590, that is, its second support face 64, on a grinding wheel 27 that is not so thin and securely clamps it. The clamping head 36 is braced against the axially outer clamping plane 59, so that the optimal clamping force between the support and clamping flanges 30, 32 exists at a gap width of approximately 2.9 to 4 mm.

In FIG. 6, as in FIG. 5, the clamping flange 32 is braced by its back side 590, that is, its second support face 64, on a thicker grinding wheel 27 and securely clamps it. The clamping head 36 is braced against the axially inner clamping plane 60, so that the optimal clamping force between the support and clamping flanges 30, 32 exists at a gap width of approximately 4 to 5.1 mm.

FIG. 7 shows the tension spindle 34 as a detail; the clamping shaft 35, clamping head 36, clamping face 37, and the radial clamping tabs 66, which are located inside a common mushroom-shaped contour, are especially clearly visible.

FIG. 8 shows the face end of the tension spindle 34, clearly showing its cylindrical shape and the radial clamping tabs 66—corresponding to the radial recesses 68 of the clamping flange 32, or its center hole 54.

FIG. 9 shows a cross section of the clamping flange 32 with the clamping flange 32 which is shown in the preceding figures and explained there, with the tension spindle 34 engaging through the center hole 54 and the clamping head 36 with the clamping shaft sitting axially on the upper clamping plane 58. or in other words axially spaced form the lower clamping plane, as a unit already shown in FIG. 3. It can be seen that the clamping flange 32 on a front side 570 has a circumferential small marking groove 33*a* and on its rear side 590 has a circumferential wide marking groove 33*b*, by means of which front and rear sides 570, 590, or their first and second supporting faces 62, 64 are easily distinguishable from one another.

FIG. 10 shows a cross-section of the clamping flange 32 as a unit which is shown in preceding figures, wherein—as shown in FIG. 9, in its front side 570 the circumferential, small marking groove 33*a* and on its rear side 590 the circumferential wide marking groove 33*b* and the center hole 54 can be seen. Moreover, the support faces 62, 64 as well as the stepped clamping faces 57, 58, 59 and 60 formed on three symmetrical support tabs 55 are clearly shown.

FIG. 11 shows a plan view of the rear side 590 or the second support face 64 of the clamping flange 32 which is shown in the preceding figures and explained there, and the design of the three clamping tabs 55 with the stepped clamping faces 57, 58, 59 and 60.

The invention claimed is:

1. A hand power tool, comprising a disk-shaped tool; and a clamping device for clamping said disk-shaped tool to said hand power tool, said clamping device including at least one flange, and clamping means passing through said tool, wherein said clamping means is provided for clamping said tool to said at least one flange, said clamping means and said at least one flange being correspondingly configured for mated engagement, wherein said clamping means and said at least one flange axially fix one another in at least one axial direction after said clamping means is inserted axially through said at least one flange and the clamping means and the at least one flange are subsequently rotated counter to one another, wherein said at least one flange is formed so as to provide at least two different clamping planes for clamping said at least one flange in a manner selected from the group consisting of interchangeably clamping, selectively clamping, and both, relative to said clamping means in a bracing position, wherein said at least one flange can be clamped against said tool in said bracing position, and wherein the clamping means is a spindle extending along a central axis with at least one radially extending clamping tab, and wherein said at least one radially extending clamping tab is clamped to at least one support tab of a counter part.

2. A hand power tool as defined in claim 1, wherein said different clamping planes define clamping positions for further disk-shaped tools having different thicknesses than said disk-shaped tool.

3. A hand power tool as defined in claim 1, wherein said at least one clamping flange has at least two clamping planes each located on both front and back sides of said clamping flange.

4. A hand power tool as defined in claim 1, wherein said at least one clamping flange has support tabs, said clamping means having three clamping tabs which are associated with said support tabs of said clamping flange.

5. A hand power tool as defined in claim 4, wherein said at least one clamping flange between said support tabs have parallel recesses which are substantially congruent to and slightly larger than said clamping tabs of said clamping means.

* * * * *